United States Patent [19]

Saleeby

[11] 3,982,707

[45] Sept. 28, 1976

[54] METHOD AND APPARATUS FOR THE PRODUCTION OF TWO PACKAGES OF YARN WITH TRANSFER TAILS

[75] Inventor: Ralph Saleeby, Wilson, N.C.

[73] Assignee: Phillips Fibers Corporation, Greenville, S.C.

[22] Filed: Feb. 10, 1975

[21] Appl. No.: 548,583

[52] U.S. Cl. ..... 242/18 PW; 242/35.5 R
[51] Int. Cl.[2] ..... B65H 54/02; B65H 65/00
[58] Field of Search ..... 242/18 PW, 35.5 R, 18 R, 242/157 R

[56] References Cited

UNITED STATES PATENTS

| | | | |
|---|---|---|---|
| 3,030,039 | 4/1962 | Roberts | 242/18 PW |
| 3,251,560 | 5/1966 | Macedo | 242/18 PW |
| 3,276,704 | 10/1966 | Pabis | 242/18 PW |
| 3,276,719 | 10/1966 | Stetz | 242/157 R |
| 3,488,010 | 1/1970 | Parry | 242/18 PW |
| 3,587,989 | 6/1971 | Fisher et al. | 242/18 R |
| 3,814,339 | 6/1974 | Hudson | 242/18 PW |
| 3,814,341 | 6/1974 | Dickson et al. | 242/18 PW |
| 3,858,816 | 1/1975 | Corbiere | 242/18 PW |

*Primary Examiner*—Stanley N. Gilreath

[57] ABSTRACT

Two packages of yarn with transfer tails are produced simultaneously on a winder wherein the winder has a driven friction roll, a dual traversing means with two traverse guides and two bobbins on a chuck and wherein the chuck is positioned adjacent the traversing means and the friction roll is positioned adjacent the traverse guides and against the chuck, by passing two yarns between the traversing means and the friction roll and then between the chuck and the friction roll while holding the yarns approximately in the center of the traversing means and out of the traverse guides; passing the yarns partially around the bobbins on the chuck, and while holding the yarns partially off the surface of the bobbins, passing the yarns between the traversing means and the chuck and again between the chuck and the friction roll; then while holding the ends of the yarns approximately in the center of the chuck, releasing that portion of the yarns held off the surface of the bobbins thereby winding the transfer tails; and after the transfer tails are wound, releasing the yarns held in the center of the traversing means thereby permitting the traverse guides to pick up the yarns to wind the packages. Apparatus suitable for use in the above process is provided.

8 Claims, 6 Drawing Figures

METHOD AND APPARATUS FOR THE PRODUCTION OF TWO PACKAGES OF YARN WITH TRANSFER TAILS

BACKGROUND

The invention relates to a method and apparatus for the production of two packages of yarn with transfer tails.

In processing yarn it is generally desirable to use a continuous process. Transfer tails, that is, a length of yarn ranging from about 6 to about 24 inches which precedes the initial wraps of yarn on the package, are used to tie the end of one package of yarn to the beginning of another package of yarn in order to provide an uninterrupted or continuous flow of yarn from a creel or other holder on which the packages are supported. When using packages of undrawn or partially drawn synthetic yarn, it is important that the transfer tails are not drawn during the packaging step or otherwise abraded or damaged as the continuous flow of yarn in the subsequent processing step is subjected to considerable stresses such as mechanical draws of up to approximately 5:1. Abraded transfer tails are those in which a few of the filaments of the yarn are broken, and these broken filaments frequently break the yarn during subsequent processing because the broken filaments wrap the draw rolls causing the other filaments to break. Also, if the transfer tails are previously drawn or oriented to a higher degree than the yarn on the package, then the subsequent draw may break the yarn and interrupt the process.

In the production of yarn, sometimes it is desirable to produce two separate packages of yarn on a single chuck by placing two bobbins on a chuck which has sufficient capacity to accommodate two bobbins. However, producing two packages of yarn with transfer tails simultaneously on a single chuck usually requires excessive free bobbin space or produces double tails. A double tail is an additional length of yarn preceding the transfer tail on the inside bobbin which is wrapped on the outside bobbin and becomes a loose piece of yarn under the wraps of yarn on the outside bobbin when the bobbins are separated.

Although various methods have been found to produce satisfactory transfer tails where a single package is wound on one chuck, there is still a need for an improved method and apparatus for simultaneously producing two packages of yarn with transfer tails on one chuck without abrading or damaging the transfer tails, using excessive free bobbin space, or producing double tails.

Therefore an object of the invention is to produce simultaneously two packages of yarn with transfer tails on a single chuck and avoiding the disadvantages of the prior art.

Another object of the invention is to provide apparatus useful to produce two packages of yarn with transfer tails simultaneously on a single chuck.

Other objects, aspects, and advantages of the invention will be apparent to those skilled in the art upon studying the drawings, specification and appended claims.

According to the invention, two packages of yarn with transfer tails are produced simultaneously on a winder wherein the winder has a driven friction roll, a dual traversing means with two traverse guides and two bobbins on a chuck and wherein the chuck is positioned adjacent the traversing means and the friction roll positioned adjacent the traverse guides and against the chuck, by passing two yarns between the traversing means and the friction roll and then between the chuck and the friction roll while holding the yarns approximately in the center of the traversing means and out of the traverse guides; passing the yarns partially around the bobbins on the chuck, and while holding the yarns partially off the surface of the bobbins, passing the yarns between the traversing means and the chuck and again between the chuck and the friction roll; then while holding the ends of the yarns approximately in the center of the chuck, releasing that portion of the yarns held off the surface of the bobbins thereby simultaneously winding the transfer tails; and after the transfer tails are wound, releasing the yarns held in the center of the traversing means thereby permitting the traverse guides to pick up the yarns to wind the packages.

Further according to the invention apparatus useful for the production of two packages of yarn with transfer tails simultaneously on a winder comprises a driven friction roll, a dual traversing means with two traverse guides, a two-bobbin chuck, stringup guiding means comprising two yarn guides capable of being positioned either in the stringup or the run position, and a stationary guide, wherein the chuck is positioned adjacent the traversing means, the friction roll is positioned adjacent the traverse guides of the traversing means and against the chuck, the stationary guide is attached to the traversing means approximately in the center and on the side opposite the traverse guides, and the yarn guides of the stringup guide means capable of guiding the yarn to approximately the center of the chuck and away from the traverse guides while in the stringup position.

DESCRIPTION OF THE DRAWINGS

Referring now to FIGS. 1 through 5, the invention is more fully explained. Yarns 10 and 12 produced in a spinning zone (not shown) are passed to a winder, generally designated by reference numeral 14. The winder comprises a traversing means 16 having two traverse guides 18 and 20, shown in FIGS. 1, 3, 4 and 5, a stringup guide means 22 with yarn slots 24 and 26 positioned approximately in the center thereof, friction roll 28 and a two bobbin chuck 30 shown with two bobbins 32 and 34. A stationary guide means 36 is positioned on traversing means 16 on the side opposite the traverse guides 18 and 20 and between slots 24 and 26 of stringup guide means 22. A stringup gun 38 is shown for use by an operator handling the yarns. Stringup gun 38 is a vacuum type or any other conventional stringup gun known in the art that takes up yarn during stringup of yarn winders or other yarn processing equipment. Chuck 30 is positioned adjacent traversing means 16, and friction roll 28 is positioned adjacent traverse guides 18 and 20 and against chuck 30. Friction roll 28 and traversing means 16 are driven by means not shown.

Figure 1:
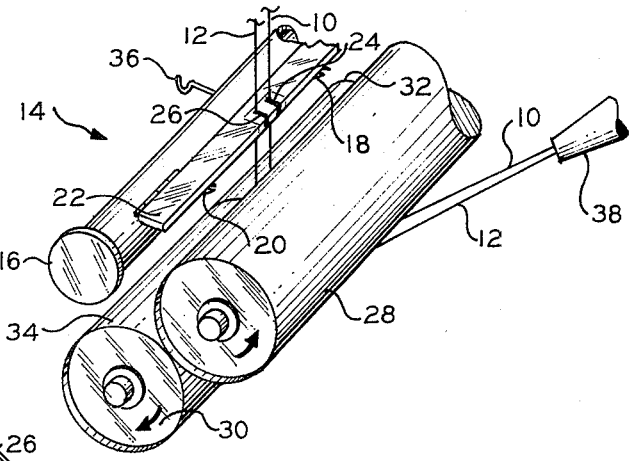
FIGS. 1 and 2 are perspective views of a winding machine embodying the apparatus of the invention and illustrating various steps in the method of the invention.

Referring specifically to FIG. 1, with friction roll 28 and chuck 30 rotating as indicated by the arrows and traversing means 16 in motion, the operator manipulates yarns 10 and 12 using stringup gun 38, threads them through yarn slots 24 and 26, respectively, between traversing means 16 and friction roll 28 and between friction roll 28 and chuck 30. Guide means 22 is in the down position. Yarn slots 24 and 26 hold the yarn 10 and 12 approximately in the center of traversing means 16 and out of traverse guides 18 and 20.

Figure 2:
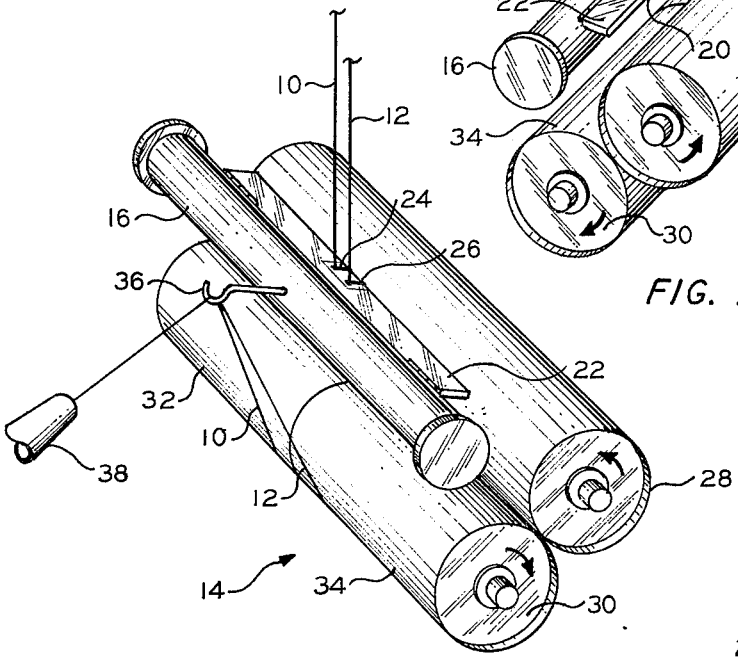

FIG. 2 illustrates the subsequent step wherein the operator uses the stringup gun 38 to guide the yarns 10 and 12 partially around bobbins 32 and 34, respectively, and then over stationary guide 36.

Figure 3:
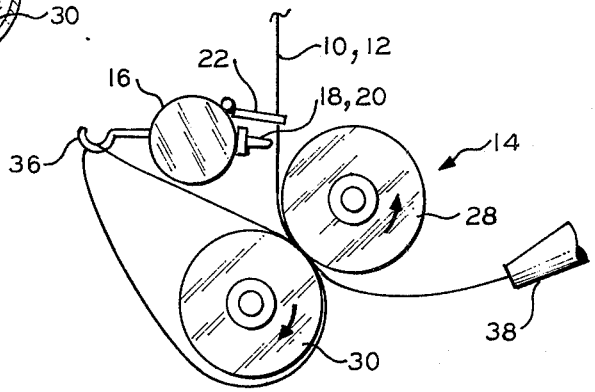
FIG. 3 is an end view of a winding machine embodying the apparatus of the invention and illustrating a step in the method of the invention.

FIG. 3 illustrates the next step in which the operator passes yarns 10 and 12 under manipulation of stringup gun 38 between traversing means 16 and chuck 30 and again between chuck 30 and friction roll 28 while stationary guide 36 holds a portion of the yarns off the surface of bobbins 32 and 34. It is noted that various methods can be used to hold a portion of the yarns off the surface of bobbins 32 and 34 besides using a stationary guide 36, such as by having the operator hold a guide in his hand; however, use of stationary guide 36 has proven to be very satisfactory.

Figure 4:
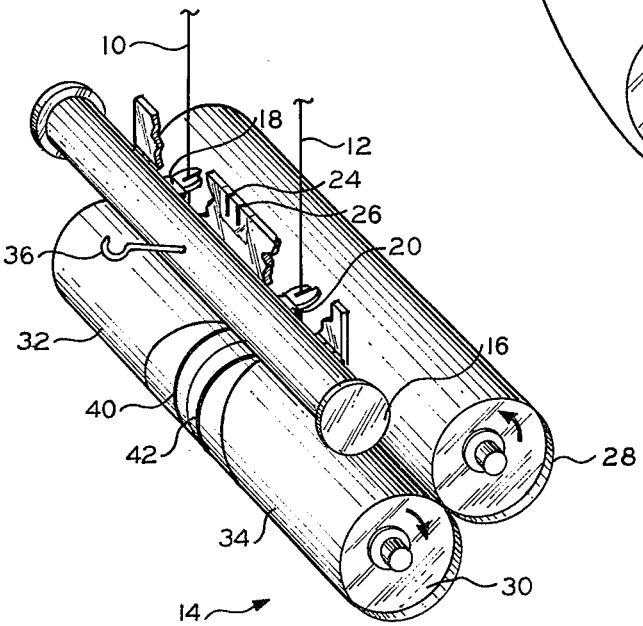
FIG. 4 is a perspective view of a winding machine with a stringup guide means partially cut away embodying the apparatus of the invention and illustrating various steps in the method of the invention.

In FIG. 4, the operator using his fingers or a smooth rod has released yarns 10 and 12 from stationary guide 36 while holding the ends of yarns 10 and 12 approximately in the center of chuck 30. Releasing the yarns 10 and 12 from guide 36 causes the yarns to break out of stringup gun 38 and wind the transfer tails 40 and 42 on bobbins 32 and 34, respectively. Since a relatively short piece of yarn is all that is required for a transfer tail, almost immediately after removing the yarns 10 and 12 from stationary guide 36, stringup guide means 22 is raised from the stringup position to the run position, releasing yarns 10 and 12 in order that traverse guides 18 and 20 can pick up the yarns and begin winding the yarns to form two packages of yarn. When the stringup guide means 22 is positioned such that yarns 10 and 12 are in slots 24 and 26, respectively, the stringup guide means is said to be in the "stringup position", see FIGS. 1 through 3, and when the stringup guide means 22 is positioned such that yarns 10 and 12 are out of slots 24 and 26, respectively, stringup guide means 22 is said to be in the "run position", see FIG. 4.

Figure 6:
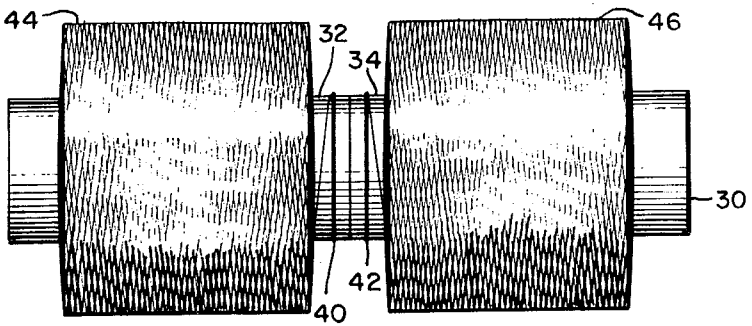
FIG. 6 is a front view of two packages of yarn with transfer tails on a chuck produced in accordance with the invention.

In FIG. 6, bobbins 32 and 34 are positioned on chuck 30. Two packages of yarn 44 and 46 are shown with transfer tails 40 and 42 on bobbins 32 and 34, respectively.

Figure 5:
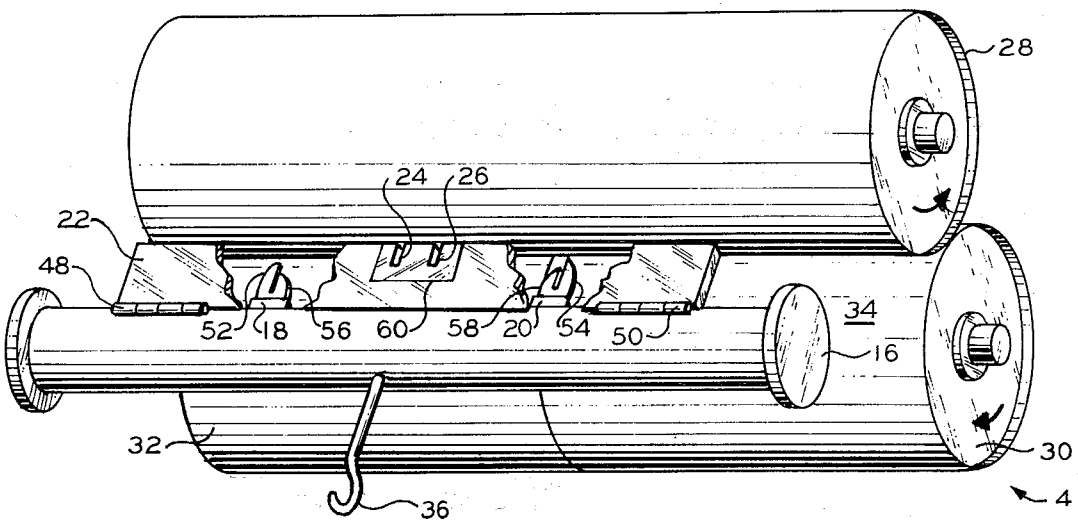
FIG. 5 is a perspective view of a winding machine embodying the apparatus of the invention with the stringup guide means partially cut away.

As shown in FIG. 5, the stringup guide means 22 can be constructed from a rectangular base which is then attached to the traversing means using hinges 48 and 50. Slots 24 and 26 can be made into the base as in FIGS. 1, 2 and 4, or a removable insert 60 as in FIG. 5 with slots 24 and 26. If an insert is used, it can be made from a material such as nylon which is fitted to the base and replaced as needed.

Slots 24 and 26 in the stringup guide means 22 not only hold the yarns out of traverse guides 18 and 20, but they also position the transfer tails 40 and 42 on bobbins 32 and 34, respectively.

It is pointed out that the method of the invention does not require the use of additional expensive equipment, since the method of the invention resides primarily in the sequence steps performed by an operator.

In the apparatus of the invention, the parts necessary to modify a winder with a two bobbin chuck are inexpensive to fabricate. Further, transfer tails are made in accordance with the invention without an increase in free bobbin space or special bobbins. The transfer tails produced in accordance with the invention are of excellent quality whether they are made from completely undrawn yarn, partially drawn yarn or fully drawn yarn. Another advantage of the invention is that no double tails are formed.

As shown in FIG. 5, traverse guides 18 and 20 each comprise a long arm 52, 54 and a short arm 56, 58. With short arm 56, 58 positioned adjacent to each other, yarns 10 and 12 are automatically picked up by the traverse guides when stringup guide means 22 is in the run position. If arms 56, 58 are the same length as arms 52, 54, it is generally necessary to manually place the yarns into the guides which often results in nonuniform distribution of the initial layers of yarn on the bobbins. Thus use of traverse guides having one long arm and one short arm is preferred.

That which is claimed is:

1. A method for producing two packages of yarn with yarn transfer tails on a winder simultaneously, wherein the winder has a friction roll, a dual traversing means with two traverse guides and two bobbins on a chuck and wherein the chuck is positioned adjacent the traversing means and the friction roll is positioned adjacent the traverse guides of the traversing means and against the chuck, said method comprising:

passing two yarns between the traversing means and the friction roll and then between the chuck and the friction roll while holding the yarns approximately in the center of the traversing means and out of the traverse guides;

passing said yarns partially around the bobbins on the chuck, and then while holding the yarns partially off the surface of the bobbins, passing the yarns between the traversing means and the chuck and again between the chuck and the friction roll;

then while holding the ends of the yarns approximately in the center of the chuck, releasing that portion of the yarns held off the surface of the bobbins thereby winding the transfer tails; and after the transfer tails are wound, releasing the yarns held in the center of the traversing means thereby permitting the traverse guides to pick up the yarns to wind the packages.

2. The method of claim 1 wherein said winder includes a stringup guiding means comprising two yarn guides affixed to a base wherein said base is hinged to said traversing means so as to position said yarn guides approximately in the center of said traversing means and wherein the yarns are held approximately in the center of the traversing means and out of the traverse guides by passing said yarns through said yarn guides wherein each yarn is in a respective one of said yarn guides.

3. The method of claim 2 wherein said winder includes a stationary guide affixed to the traversing means approximately in the center and on the side opposite the traverse guides and wherein the yarns are held partially off the surface of the bobbins by passing the yarns over said stationary guide.

4. A yarn winding apparatus comprising:

a friction roll;

a dual traversing means with two traversing guides;

a two bobbin chuck;

stringup guiding means comprising two yarn slots, the stringup guiding means being capable of being positioned either in the stringup or the run position; and a stationary guide;

wherein the chuck is positioned adjacent the traversing means; the friction roll is positioned adjacent the traversing guides of the traversing means and against the chuck, said friction roll and said chuck forming a nip for receiving yarn from said stringup guiding means or said dual traversing means; the stationary guide is attached to the traversing means approximately in the center and on the side opposite the traverse guides for receiving yarn from said nip and holding said yarn off of said chuck after said yarn is passed back to said nip; and the stringup guiding means is positioned adjacent to the traversing means wherein the yarn slots of the stringup guiding means are positioned for guiding the yarn to approximately the center of the chuck and away from the traversing guides while in the stringup position.

5. The apparatus of claim 4 wherein said stringup guiding means comprises the two yarn slots and a base wherein said yarn slots are affixed to said base and said base is hinged to said traversing means so as to position said yarn slots approximately in the center of said traversing means.

6. The apparatus of claim 5 wherein said traverse guides each comprises a long arm and a short arm and said guides are positioned on said traversing means with the short arms adjacent each other.

7. The method of claim 2 wherein said yarns held in the center of the traversing means by said yarn guides are released to permit the traverse guides to pick up the yarns by moving the base so that the yarns are released from said yarn guides.

8. The method of claim 3 wherein said yarns held partially off the surface of the bobbin are released to wind the transfer tails by releasing the yarns from said stationary guide.

* * * * *